US007082898B2

(12) United States Patent
Kitamura et al.

(10) Patent No.: US 7,082,898 B2
(45) Date of Patent: Aug. 1, 2006

(54) INTERNAL COMBUSTION ENGINE OF COMPRESSION IGNITION TYPE

(75) Inventors: Tohru Kitamura, Saitama (JP); Tomio Kimura, Saitama (JP); Shohei Okazaki, Saitama (JP); Akira Kato, Saitama (JP); Toshihiro Yamaki, Saitama (JP); Katsura Okubo, Saitama (JP); Moriyoshi Awasaka, Saitama (JP); Junji Yasuda, Saitama (JP); Yasuhiro Urata, Saitama (JP); Takashi Kakinuma, Saitama (JP); Yoshimasa Kaneko, Saitama (JP)

(73) Assignee: Honda Motor Co. Ltd., Tokyo (JP)

( * ) Notice: Subject to any disclaimer, the term of this patent is extended or adjusted under 35 U.S.C. 154(b) by 14 days.

(21) Appl. No.: 10/817,956

(22) Filed: Apr. 6, 2004

(65) Prior Publication Data

US 2004/0237910 A1 Dec. 2, 2004

(30) Foreign Application Priority Data

Apr. 16, 2003 (JP) ..... 2003-111410
Feb. 2, 2004 (JP) ..... 2004-025605

(51) Int. Cl.
*F02B 1/14* (2006.01)

(52) U.S. Cl. ..... 123/21; 123/316

(58) Field of Classification Search ..... 123/21, 123/316
See application file for complete search history.

(56) References Cited

U.S. PATENT DOCUMENTS

| | | | | |
|---|---|---|---|---|
| 4,945,870 | A * | 8/1990 | Richeson | 123/90.11 |
| 5,022,353 | A * | 6/1991 | Kamamura | 123/21 |
| 5,113,805 | A * | 5/1992 | Kawamura | 123/21 |
| 6,286,466 | B1 * | 9/2001 | Braun et al. | 123/21 |
| 6,615,771 | B1 * | 9/2003 | Denger et al. | 123/21 |
| 2004/0237910 | A1 * | 12/2004 | Kitamura et al. | 123/21 |
| 2004/0244732 | A1 * | 12/2004 | Kojic et al. | 123/21 |

FOREIGN PATENT DOCUMENTS

| | | |
|---|---|---|
| JP | 10-196424 | 7/1998 |
| JP | 2000-087749 | 3/2000 |

* cited by examiner

*Primary Examiner*—Noah P. Kamen
*Assistant Examiner*—Jason Benton
(74) *Attorney, Agent, or Firm*—Arent Fox PLLC

(57) ABSTRACT

The present invention aims at expanding an operation range for allowing a compression ignition combustion operation. The present invention provides an internal combustion engine of a compression ignition type that is capable of operating with a compression ignition combustion scheme in a given operation range. The ECU of the internal combustion engine detects an operating condition of the internal combustion engine and determines, according to the detected operating condition, which mode is to be used operate the internal combustion engine, a 4-cycle compression ignition mode or a 2-cycle compression ignition mode. The ECU controls the internal compression engine to perform the compression ignition mode determined. According to the present invention, the compression ignition combustion operation is switched from 4-cycle to 2-cycle when the operating condition of the internal combustion engine is in such state that the 4-cycle compression ignition mode cannot be performed, fro example, when the exhaust temperature is low.

9 Claims, 8 Drawing Sheets

INTERNAL COMBUSTION ENGINE OF COMPRESSION IGNITION TYPE

BACKGROUND OF THE INVENTION

The present invention relates to an internal combustion engine that is capable of operating in accordance with two combustion types of ignition, namely, spark ignition and compression ignition, and in particular it relates to an internal combustion engine that operates to switch between a 2-cycle compression ignition and a 4-cycle compression ignition in accordance with operating conditions of the engine and environmental conditions.

A compression ignition type of internal combustion engine has advantages of better fuel economy (gas mileage) because of high compression ratio and lower NOx exhaust amount because of low combustion temperature. In order to induce a compressed self-ignition, it is required to raise a gas temperature in a combustion chamber beyond a predetermined temperature. For that purpose, such schemes as intake air heating, internal EGR and the like are generally used. When the temperature in the combustion chamber is lower than a predetermined temperature (that is, at a low-load operation time), the operation of the engine needs to be switched to the spark ignition type of combustion because the temperature may not be high enough even around the top dead center (TDC). Otherwise, misfiring would take place because of low temperature (Japanese Patent Application Unexamined Publication (Kokai) No. 2000-87749).

In general, however, the spark ignition combustion has worse fuel economy and larger exhaust amount of the nitrogen oxides (NOx) than the compression ignition combustion. Therefore, there exists a need for carrying out compression ignition combustion even when the temperature in the cylinder is low.

Thus, it is an objective of the present invention to provide a compression ignition type of internal combustion engine in which an operation range allowing for the compression ignition combustion is expanded.

SUMMARY OF THE INVENTION

According to one aspect of the present invention, there is provided an internal combustion engine of a compression ignition type that is capable of operating with a compression ignition combustion scheme in a given operation range. The internal combustion engine includes detecting means for detecting an operating condition of the internal combustion engine, determining means for determining, according to the detected operating condition, which mode of operation should be used, a 4-cycle compression ignition mode or a 2-cycle compression ignition mode, and controlling means for controlling the internal compression engine to operate in the compression ignition mode determined by the determining means.

According to this aspect of the invention, the operation is switched to the 2-cycle compression ignition combustion when the operating condition of the internal combustion engine is such that the engine cannot perform the 4-cycle compression ignition combustion, for example, when the exhaust gas temperature is low. Thus, the compression ignition combustion of a better fuel economy than the spark ignition combustion is used even in a low load range.

The operating conditions for determining a switching between the 4-cycle compression ignition mode and the 2-cycle compression ignition mode include, for example, a rotational speed and a required torque of the internal combustion engine. The internal combustion engine is provided with a sensor for detecting the rotational speed and means for calculating the required torque. As another example, an air fuel ratio and/or an exhaust temperature are included in such operating conditions. In this case, the internal combustion engine is provided with an air fuel ratio sensor and/or an exhaust temperature sensor attached to an exhaust pipe.

According to another aspect of the present invention, the engine of the compression ignition type includes torque maintaining means. The torque maintaining means prevents a variation in output torques of the internal combustion engine when the operation mode is changed from 4-cycle to 2-cycle in accordance with determination by the determining means.

In the 4-cycle compression ignition mode, the combustion would become unstable if the exhaust gas temperature (EGR temperature) becomes too low. According to an aspect of the present invention, the range for the compression ignition mode can be expanded by switching the operation to the 2-cycle compression ignition combustion, which enables the combusted fuel gas to be promptly utilized as the EGR input to the next combustion cycle. Thus, the compression ignition combustion can be performed stably across the lower load range, so that deterioration of the fuel economy and/or the NOx exhaustion can be prevented.

DESCRIPTION OF THE PREFERRED EMBODIMENTS

Preferred embodiments of the present invention will now be described referring to the accompanying drawings.

Figure 1:
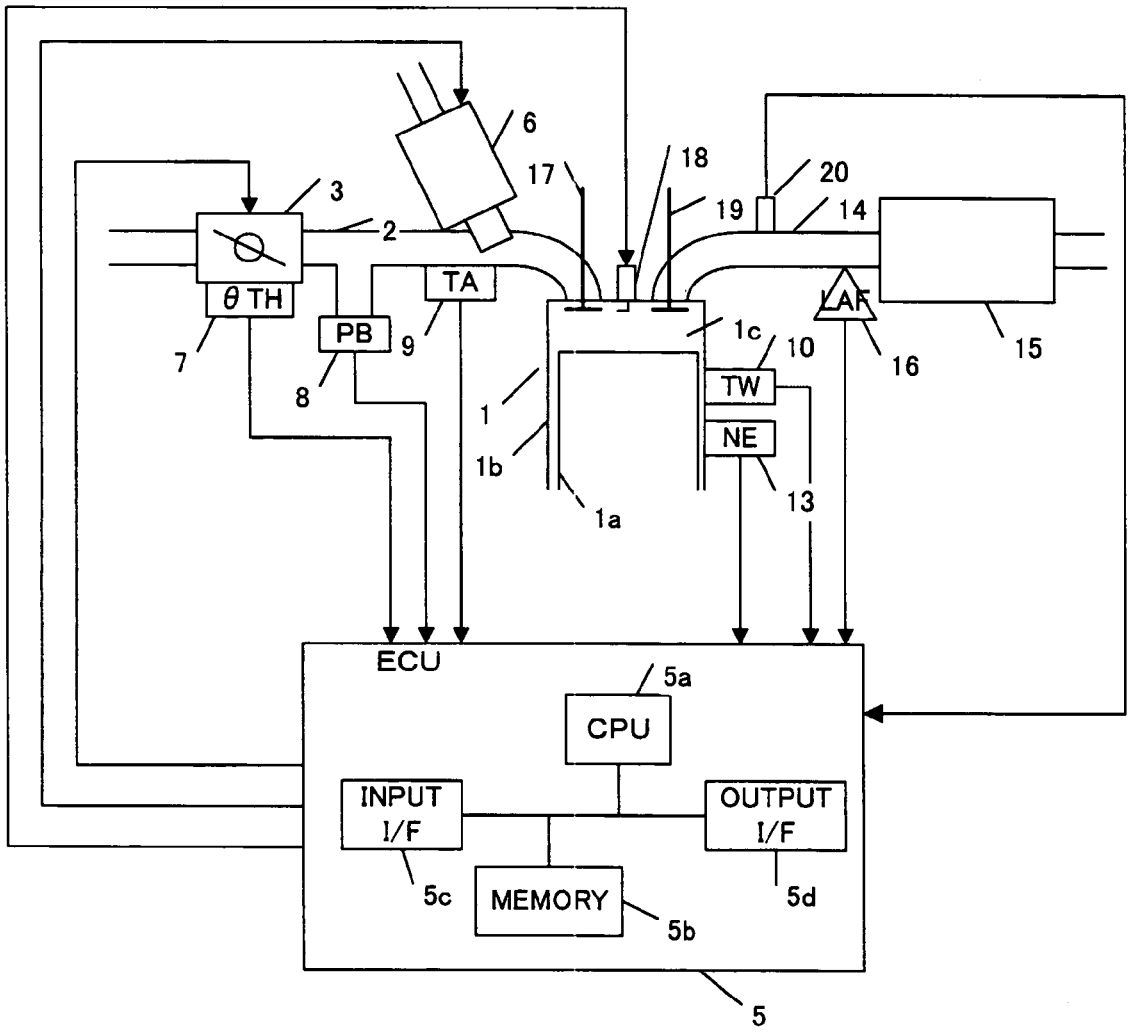
FIG. 1 shows a block diagram of an internal combustion engine in accordance with the present invention.

FIG. 1 is a block diagram of an internal combustion engine in accordance with one embodiment of the present invention. An internal combustion engine (hereinafter referred to as an "engine") 1 is an inline 4-cylinder type of engine (only one cylinder is shown in FIG. 1) which can operate in accordance of two types of combustion, that is, a type of homogeneous charge compression ignition combustion (hereinafter referred to as "HCCI combustion") and another type of spark ignition combustion (hereinafter referred to as "SI combustion"). The engine 1 has a piston 1*a* and a cylinder 1*b*. A combustion chamber 1*c* is formed between the piston and the cylinder head. A spark plug 18 is attached in the combustion chamber 1*c*. The spark plug 18 is ignited in accordance with a signal from an electronic control unit (hereinafter referred to as an "ECU") 5 when an SI combustion is performed. The structure of the ECU 5 will be described later.

In each cylinder of the engine 1, there are provided an air intake valve 17 for controlling an air intake from an air intake pipe 2 into the combustion chamber 1*c* and an exhaust valve 19 for controlling an emission from the combustion chamber 1*c* into an exhaust pipe 14. The air intake valve 17 and the exhaust valve 19 are preferably solenoid valves and are driven in accordance with signals from the ECU 5. The ECU 5 changes a timing for opening and closing the intake valve 17 and the exhaust valve 19 based on an engine rotational speed, an intake air temperature, an engine water temperature and so on which are detected by various sensors so as to achieve an optimal valve timing corresponding to the operating condition. An amount of internal emission gas re-circulation (EGR) is adjusted by the control of the intake valve 17 and the exhaust valve 19, so that the combustion temperature can be adjusted and a density of NOx contained in the exhaust gas can be decreased.

In a passage of the intake pipe 2, there is disposed a throttle valve (that is, a DBW (Drive-By-Wire) throttle valve) 3 for adjusting a flow amount of the air passing through inside the intake pipe. The throttle valve 3 is connected to an actuator (not shown) for controlling an opening θ TH. The actuator is electrically connected to the ECU 5 to control the throttle valve opening θTH, in other words, the intake air amount, in accordance with a signal from the ECU 5. The throttle valve 3 is set to an opening degree corresponding to an opening of an accelerator pedal when the engine 1 is in the SI operation whereas it is almost fully opened when the engine 1 is in the HCCI operation.

An intake air pressure sensor 8 and an intake air temperature sensor 9 are disposed downstream of the throttle valve 3 of the air intake pipe 2 to detect an air-intake-pipe internal pressure PB and an intake air temperature TA respectively. Signals of the pressure PB and the temperature TA are sent to the ECU 5.

An accelerator opening sensor 21 for detecting a depression amount of an accelerator pedal is additionally provided to detect an accelerator pedal opening ACC. The detected signal is sent to the ECU 5.

Besides, a fuel injection valve 6 is, for each cylinder, provided in an air intake pipe 2. Each fuel injection valve 6 is connected to a fuel pump (not shown). An amount of fuel supply to the engine 1 is determined by controlling a fuel injection time TOUT of the fuel injection valve 6 in accordance with a driving signal from the ECU 5.

A crank angle sensor is attached to a crankshaft (not shown) of the engine 1. The crank angle sensor outputs a TDC signal, which is a pulse signal, in accordance with a rotation of the crankshaft. The TDC signal is a pulse signal that is generated in a predetermined timing around a position of a top dead center at an intake stroke starting time of the piston in each cylinder. One pulse is output for every 180-degree rotation of the crankshaft. A rotational speed sensor 13 is also attached to the engine 1 to detect an engine rotational speed NE. The detected signal is sent to the ECU 5.

An exhaust temperature sensor 20 is disposed in the exhaust pipe 14 to detect an exhaust temperature TEX. The detected temperature is converted to a corresponding signal, which is then sent to the ECU 5.

The exhaust gas passes through the exhaust pipe 14 and then flows into an exhaust gas purification device 15. The exhaust gas purification device 15 includes a NOx adsorption catalyst (LNC) and/or the like. An air-fuel ratio sensor (hereinafter referred to as a "LAF sensor") 16 is disposed upstream of the exhaust gas purification device 15 to generate a level of output that is in proportion to a wide range of the exhaust air-fuel ratio. The output of this sensor is sent to the ECU 5.

The ECU 5 includes a microcomputer having a CPU 5*a* for performing various control programs, a memory 5*b* including a RAM for temporarily storing programs and data required at a run time and providing a working space for calculations and a ROM for storing programs and data. The ECU 5 also includes an input interface 5*c* for processing input signals from various sensors and an output interface 5*d* for sending control signals to each section.

The ECU 5 calculates a required torque PMECMD based on the inputs from each sensor. The required torque PMECMD is obtained by first calculating a target driving force based on an accelerator pedal stroke and a vehicle speed and then adjusting the calculated target driving force in consideration of a shift position, a gear ratio, a torque converter efficiency and so on. A related technique in this respect is described, for example, in the Japanese Patent Application Unexamined Publication (Kokai) No. 10-196424.

Subsequently, the ECU 5 calculates a basic fuel injection amount corresponding to the required torque and then determines a timing for injecting the fuel. Furthermore, the ECU 5 determines the operating condition of the engine 1 based on the inputs from each sensor to calculate an ignition timing of the spark plug 18, an opening θTH of the intake air throttle valve 3 and so on in accordance with the control programs stored in the ROM and the other factors. The ECU 5 outputs a driving signal corresponding to the calculation result through the output interface 5*d* so as to control the throttle valve 3, the fuel injection valve 6, the spark plug 18, the air intake valve 17, the exhaust valve 19 and so on. Through this control operation, the combustion type of the engine 1 can be switched between the HCCI combustion and the SI combustion as well as between the 4-cycle and the 2-cycle.

Figure 4:
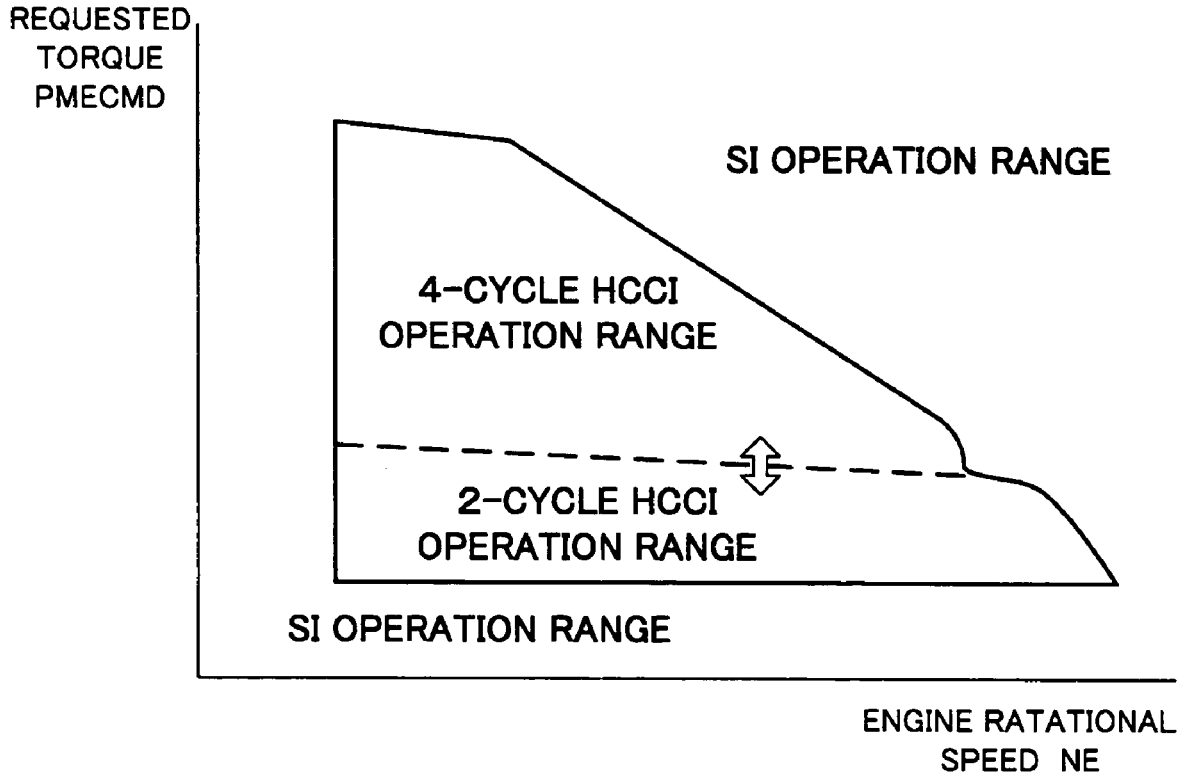
FIG. 4 schematically shows respective operation ranges for a 4-cycle compression ignition mode, a 2-cycle compression ignition mode and a 4-cycle spark ignition mode.

The operating condition is determined by searching a map stored in the ROM within the ECU 5 based on the rotational speed NE of the engine 1 and the requested torque PMECMD. The operating condition is determined depending on whether the engine 1 is either in an operation range for performing the HCCI combustion (this range will be hereinafter referred to as a "HCCI operation range") or in an operation range for performing the SI combustion (this range will be hereinafter referred to as a "SI operation range"). Basically, a range in which the engine rotational speed NE is higher and the engine load is higher is regarded as the HCCI combustion range whereas in such situation as a cold-start time, a low-load operation time and a high-load operation time, the range is regarded as the SI combustion range because there may occur such problems of misfiring and/or knocking (FIG. 4).

However, it is desirable to expand the HCCI operation range because the fuel economy in the HCCI combustion is generally better than the SI combustion. Now, referring to FIG. 2 and FIG. 3, the following will describe how the HCCI operation range can be expanded by switching between a 4-cycle HCCI combustion and a 2-cycle HCCI combustion.

In general, the HCCI combustion is easy to be ignited in a higher load condition where a fuel amount is richer, but it is not easily ignited in a lower load condition where the fuel amount is rather less. Therefore, in a lower load condition, it is required to utilize such heat as is available from the internal EGR and/or the like in order to increase the gas temperature in the cylinder before each compression stroke.

Figure 2:
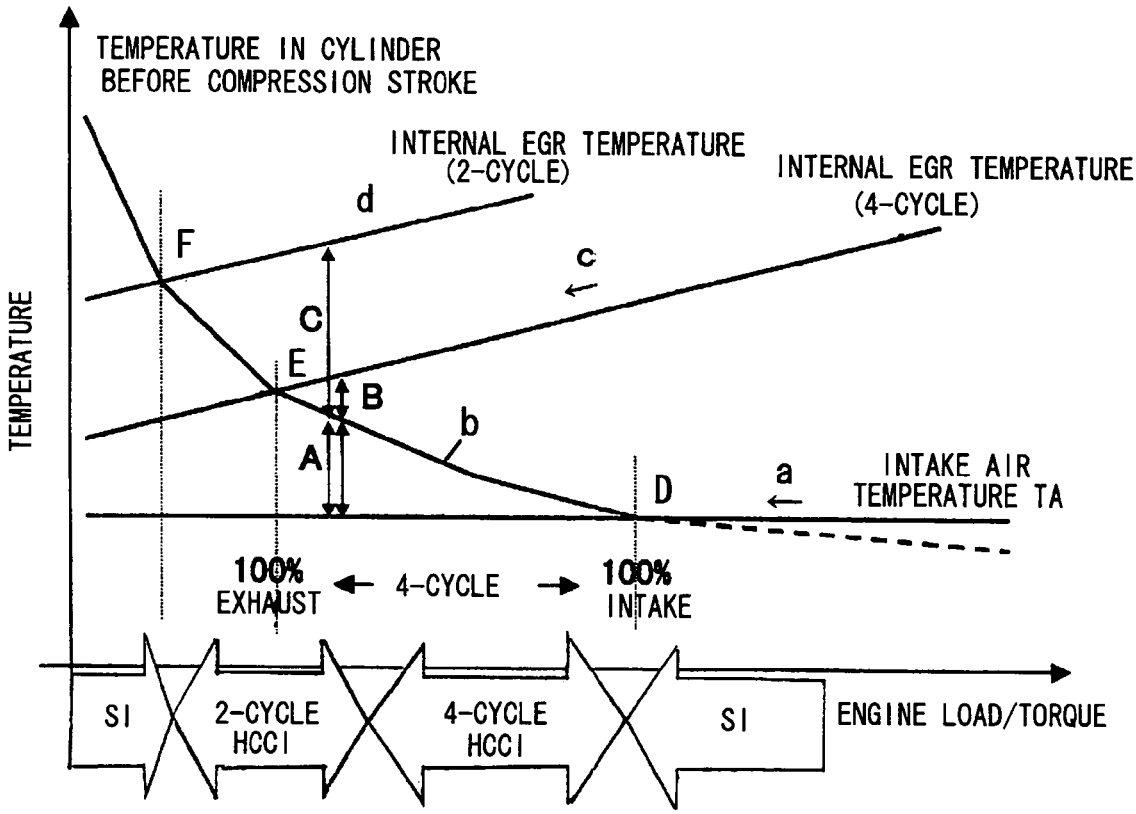
FIG. 2 schematically shows operating conditions for switching between a 4-cycle compression ignition mode and a 2-cycle compression ignition mode.

FIG. 2 shows a relation between the engine load and the temperature in the cylinder in the HCCI combustion. A line "b" represents a minimum temperature in the cylinder before a compression stroke (cycle). The minimum temperature is the temperature required for carrying out the HCCI combustion. In FIG. 2, assuming that the intake air temperature TA is constant, as the load in the horizontal axis is gradually decreased (in a direction indicated by an arrow "a"), a point D is eventually encountered at which the internal EGR gas needs to be utilized to raise the temperature in the cylinder to a level required for the combustion stroke, which cannot be achieved only with the intake air. An EGR gas ratio required for attaining a target gas temperature in the cylinder increases as the engine load decreases because the temperature of the internal EGR also decreases proportionally (in a direction indicated by an arrow "c"). The required EGR gas ratio can be represented by A/(A+B) (A and B are shown in FIG. 2). A point E shows a limit for the EGR gas ratio. However, the range in which the 4-cycle HCCI operation is actually allowed is limited to a range indicated by a block arrow carrying a phrase "4-cycle HCCI" in FIG. 2 because a certain amount of fresh air is required in order to achieve the combustion and there is an actual limit in the rate of the EGR gas that can be practically introduced.

It should be noted that the EGR temperature in the 4-cycle HCCI combustion is relatively low in comparison with the 2-cycle HCCI combustion because there are two strokes from an exhaust stroke to a compression stroke in the 4-cycle HCCI combustion. In other words, in the 2-cycle HCCI combustion, it is possible to use the EGR gas having a higher temperature in order to raise the temperature in the cylinder (refer to a line d). Accordingly, in case of the 2-cycle HCCI combustion, an amount of the EGR gas for obtaining the equivalent temperature in the cylinder is relatively small in comparison with the 4-cycle HCCI combustion. The required rate of the EGR gas for the 2-cycle HCCI combustion can be represented by A/(A+C) (A and C are shown in FIG. 2). Similarly, there is a limit for allowing the 2-cycle HCCI combustion for the same reason as for the 4-cycle HCCI combustion. A point F in FIG. 2 represents such limit. Besides, the range for allowing for the 2-cycle HCCI operation is actually limited to a range indicated by a block arrow carrying a phrase "2-cycle HCCI" in FIG. 2.

Thus, it is possible to expand the range for allowing the HCCI operation by switching to the 2-cycle HCCI combustion.

Figure 3:
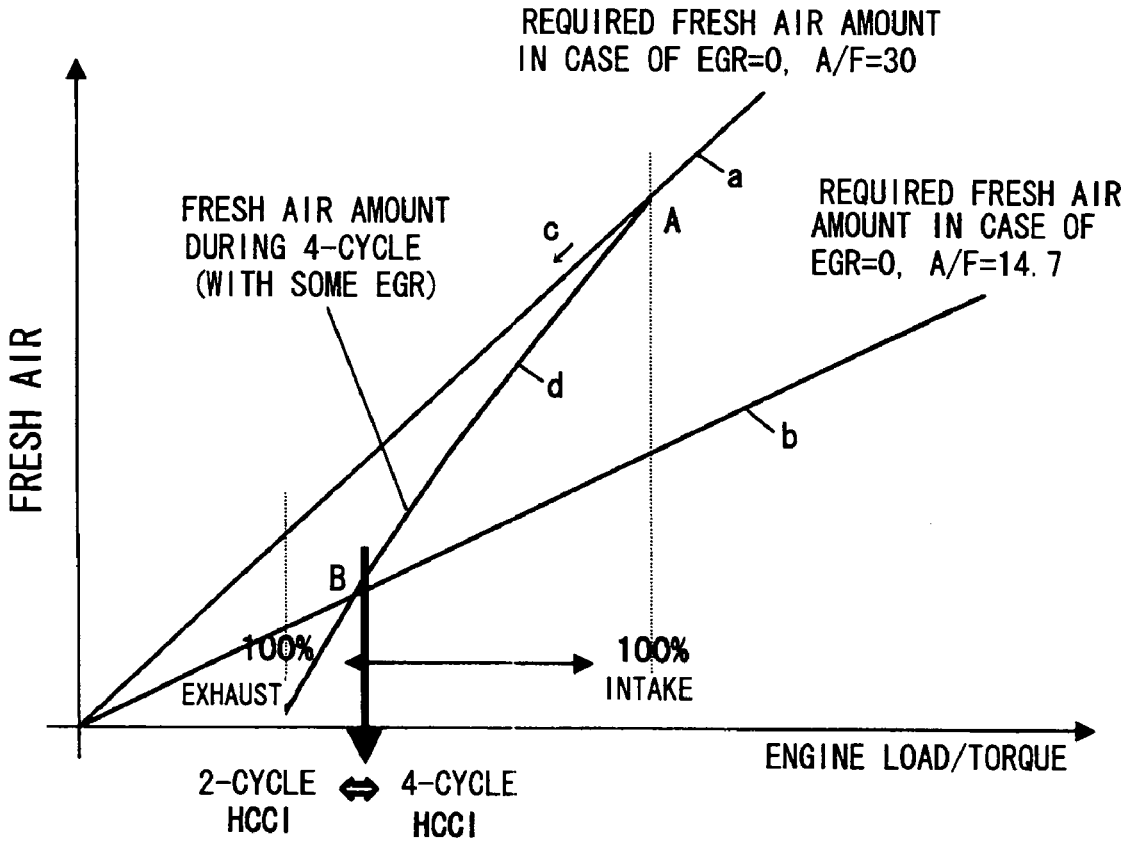
FIG. 3 schematically shows operating conditions for switching between a 4-cycle compression ignition mode and a 2-cycle compression ignition mode.

FIG. 3 shows a relation of an engine load with a fresh air amount in the HCCI combustion. In the HCCI combustion, a fuel amount and a generated torque are proportional each other. Therefore, when the air fuel ratio is constant, the fresh air amount is directly proportional to the engine load as shown in lines "a" and "b" in FIG. 3. In a point A in FIG. 4, the HCCI combustion can be performed with the air fuel ratio of 30 and the fresh air of 100% (EGR of 0%). However, when a lower load operation is tried while the air fuel ratio is kept unchanged (in a direction indicated by an arrow C in FIG. 3), there may occur a misfiring because, only with the fresh air, it is difficult to obtain the required gas temperature in the cylinder before the compression stroke. Therefore, as the engine load becomes lower, the EGR gas amount needs to be increased proportionally. A line "d" in FIG. 3 indicates the fresh air amount in such situation. However, although such increase of the EGR gas amount allows the operation on the side of the lower load, it becomes impossible to perform the 4-cycle HCCI combustion when the air fuel ratio becomes equal to or less than 14.7 (point B). This is caused by shortage of oxygen. Therefore, the operation is switched over to the 2-cycle HCCI combustion in the point B. Then, the EGR gas of a higher temperature can be used, so that the amount of the EGR gas to be introduced into the cylinder can be reduced and the fresh air amount for satisfying the ignition condition can be secured. Thus, the range for allowing the HCCI operation can be expanded.

FIG. 4 is an exemplary map to be used for determining a 4-cycle HCCI operation range, a 2-cycle HCCI operation range and an SI operation range. A boundary of the 4-cycle HCCI operation range and the 2-cycle HCCI operation range is shown by a dotted line in FIG. 4 because this boundary is variable in accordance with the operating conditions. Besides, a boundary of the SI operation range and the HCCI operation range is also variable in accordance with the air fuel ratio, the exhaust temperature and the intake air temperature although this boundary is not shown in FIG. 4.

Figure 5:
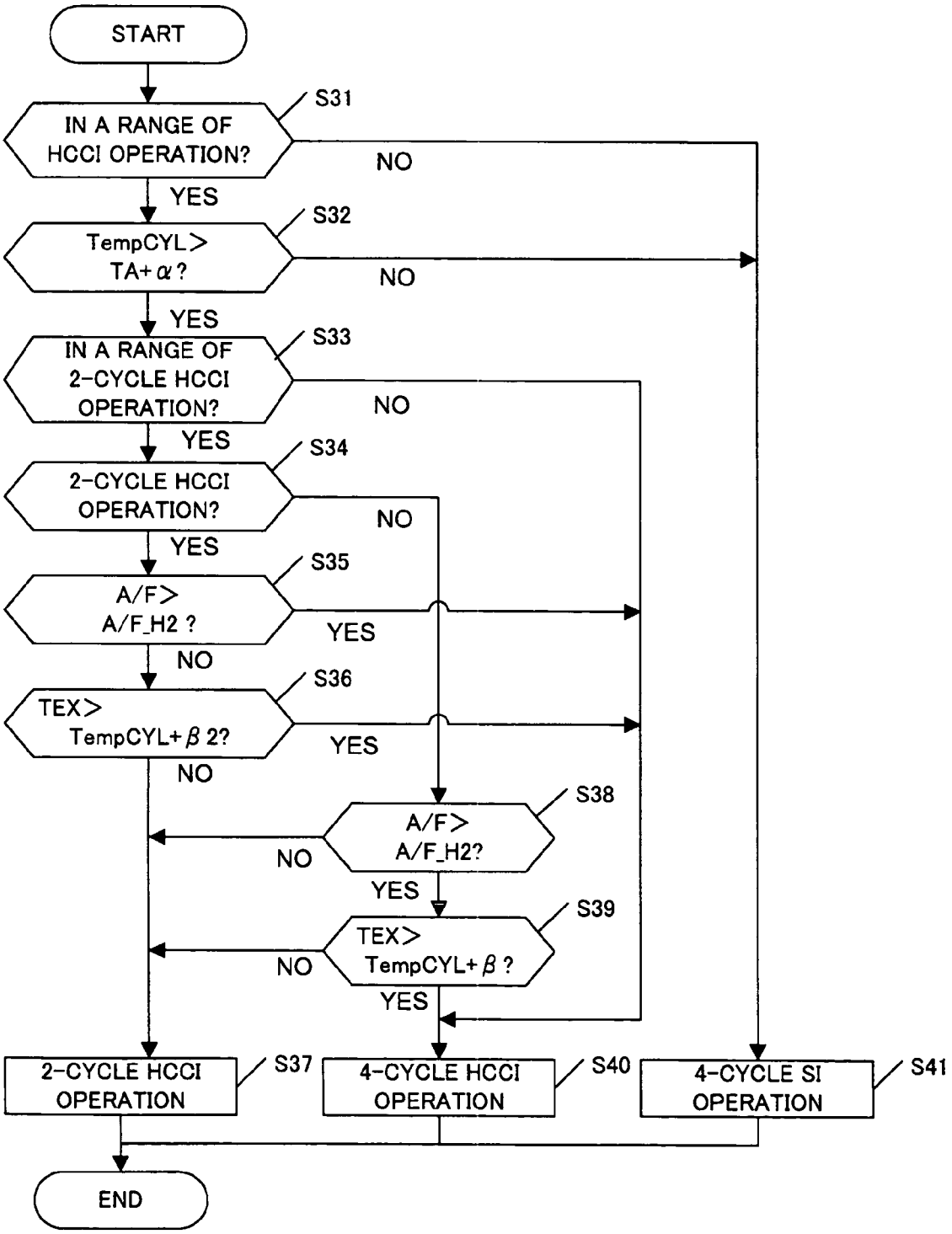
FIG. 5 shows a flowchart of a control for switching among a 4-cycle compression ignition mode, a 2-cycle compression ignition mode and a 4-cycle spark ignition mode.

Referring to a flowchart in FIG. 5, one embodiment of a process for determining a switchover between the 4-cycle HCCI operation and the 2-cycle HCCI operation will now be described.

In Step S31, it is determined whether or not the operating condition is in the HCCI operation range. The operating condition is represented, for example, by an engine rotational speed NE and a requested torque PMECMD. The values of NE and PMECMD are used to search the map of FIG. 4 in order to determine whether or not the operating condition is in the HCCI operation range (in other words, whether it is in the "4-cycle HCCI operation range" or in the "2-cycle HCCI operation range" shown in FIG. 4).

When the current operating condition is not in the HCCI operation range, the engine 1 performs the 4-cycle SI operation (S41). When the operating condition is in the HCCI operation range, it is determined whether or not a temperature calculated by adding an allowance $\alpha$ to the current intake air temperature TA is less than a target temperature in the cylinder TempCYL required for performing the HCCI combustion (S32). The target temperature in the cylinder TempCYL is determined based on the engine rotational speed NE and the requested torque PMECMD. When TA+$\alpha$ is less than the target temperature in the cylinder TempCYL, the 4-cycle SI operation is performed (S41) because it is not possible to raise the temperature in the cylinder up to TempCYL. When TA+$\alpha$ exceeds the target temperature in the cylinder TempCYL, it is determined whether the current operating condition is either in the 4-cycle HCCI operation range or in the 2-cycle HCCI operation range shown in FIG. 4 (S33). When the current operating condition is in the 4-cycle HCCI operation range, the 4-cycle HCCI operation is carried out (S40). When the current operating condition is in the 2-cycle HCCI operation range, it is further determined whether or not the engine is currently performing the 2-cycle HCCI operation (S34). This determination is performed in order to set a hysteresis at the switching time between the 2-cycle HCCI operation and the 4-cycle HCCI operation as will be described below.

At first, it is determined whether or not the air fuel ratio A/F exceeds a given value AF_H2 (S35). When the air fuel ratio A/F exceeds the given value AF_H2 (lean), the 4-cycle HCCI operation is carried out because it is regarded that the oxygen amount is sufficient to perform the 4-cycle HCCI operation with the current air fuel ratio (S40). When the air fuel ratio A/F is no more than the given value AF_H2 (rich), it is further determined whether or not the actual exhaust gas temperature TEX exceeds a value calculated by adding an allowance $\beta$2 to the target temperature in the cylinder TempCYL (S36). The exhaust gas temperature TEX is detected by the exhaust gas temperature sensor 20. Alternatively, it may be estimated from the operating condition of the engine. When the decision of S36 is YES, the 4-cycle HCCI operation is carried out (S40) because it is regarded that the temperature in the cylinder is enough to perform the 4-cycle HCCI operation. When the decision of S36 is NO, the 2-cycle HCCI operation is carried out (S37).

When it is determined in Step S34 that the 2-cycle HCCI operation is not currently performed (that is, the 4-cycle HCCI operation is being performed), it is determined whether or not the air fuel ratio A/F exceeds the given value AF_H2 (S38). When the air fuel ratio A/F is no more than the given value AF_H (rich), the operation is switched to the 2-cycle HCCI (S37). When the air fuel ratio A/F exceeds the given value AF_H2 (lean), it is further determined whether or not the actual exhaust gas temperature TEX exceeds a value calculated by adding an allowance β to the target temperature in the cylinder TempCYL (S39). When the decision of Step S39 is NO, the operation is switched to the 2-cycle HCCI (S37) because the temperature in the cylinder is regarded to be not so high to perform the 4-cycle HCCI operation. When the decision of S39 is YES, the 4-cycle HCCI operation is continued (S40).

The above-referenced allowances β and β2 are defined in consideration of heat radiation or the like until the actual combustion starts. These allowances may be determined through an experiment and/or a simulation. β and β2 may have the same value.

According to the above-described switching process between the 4-cycle HCCI operation and the 2-cycle HCCI operation, it is possible to expand the HCCI operation range more than conventional approaches.

In one embodiment, the determination of switching between the 4-cycle HCCI operation and the 2-cycle HCCI operation may be made based on only the operating conditions (for example, the engine rotational speed and the requested torque). However, in this case, even when the engine rotational speed NE and the requested torque PMECMD are kept unchanged, the air fuel ratio and the exhaust gas temperature may exhibit some variation due to variations of the engine and the fuel. Therefore, the respective operation-switching points need to be set on the safer side, which is resulted in making the 4-cycle operation range narrower. Accordingly, as described above with reference to the flowchart of FIG. 5, it is preferable to switch between the 4-cycle HCCI operation and the 2-cycle HCCI operation in consideration of such additional factors as the air fuel ratio (S35 and S38), the intake air temperature (S32) and the exhaust temperature (S36 and S39). In such way, it is possible to expand the range for the 4-cycle HCCI operation that is regarded to be rather excellent in terms of fuel economy, emission and product property.

Figure 6:
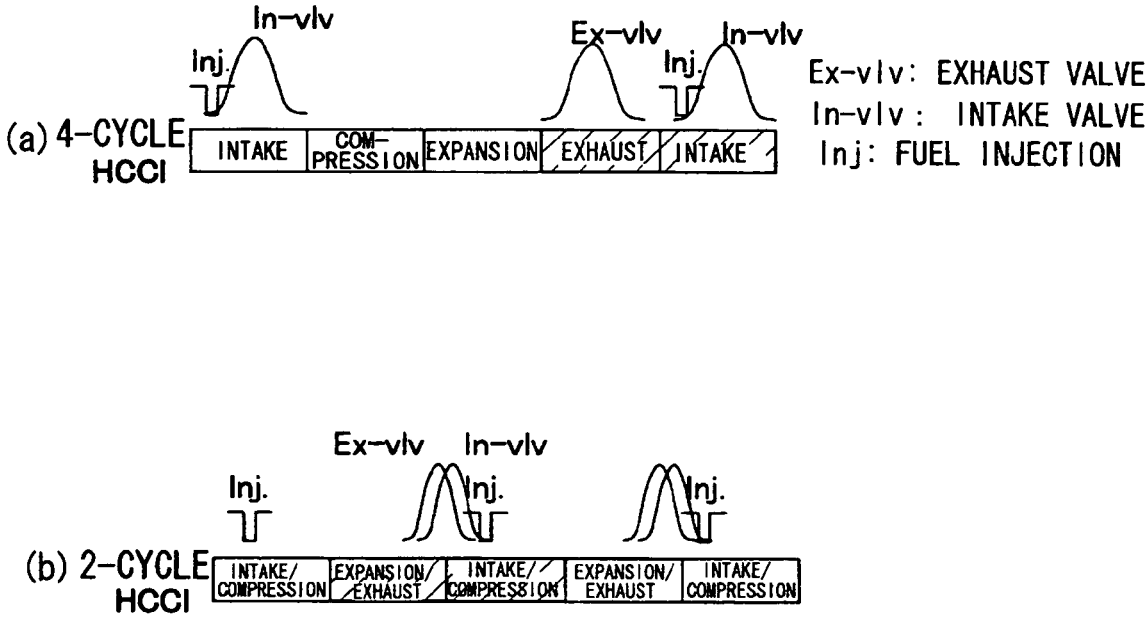
FIG. 6 schematically shows a switching of a fuel injection timing and a valve timing to be required for switching between 2-cycle and 4-cycle.

FIG. 6 shows a fuel injection timing and a valve opening timing for the intake valve and the exhaust valve (a) during the 4-cycle HCCI operation and (b) during the 2-cycle HCCI operation. When the 4-cycle HCCI operation or the 2-cycle HCCI operation is determined to be performed, the ECU 5 sends a signal to the fuel injection valve 6 as well as the intake valve 17 and the exhaust valve 19 so that the fuel injection and the intake/exhaust can be performed in the timing as shown in FIG. 6.

Figure 7:
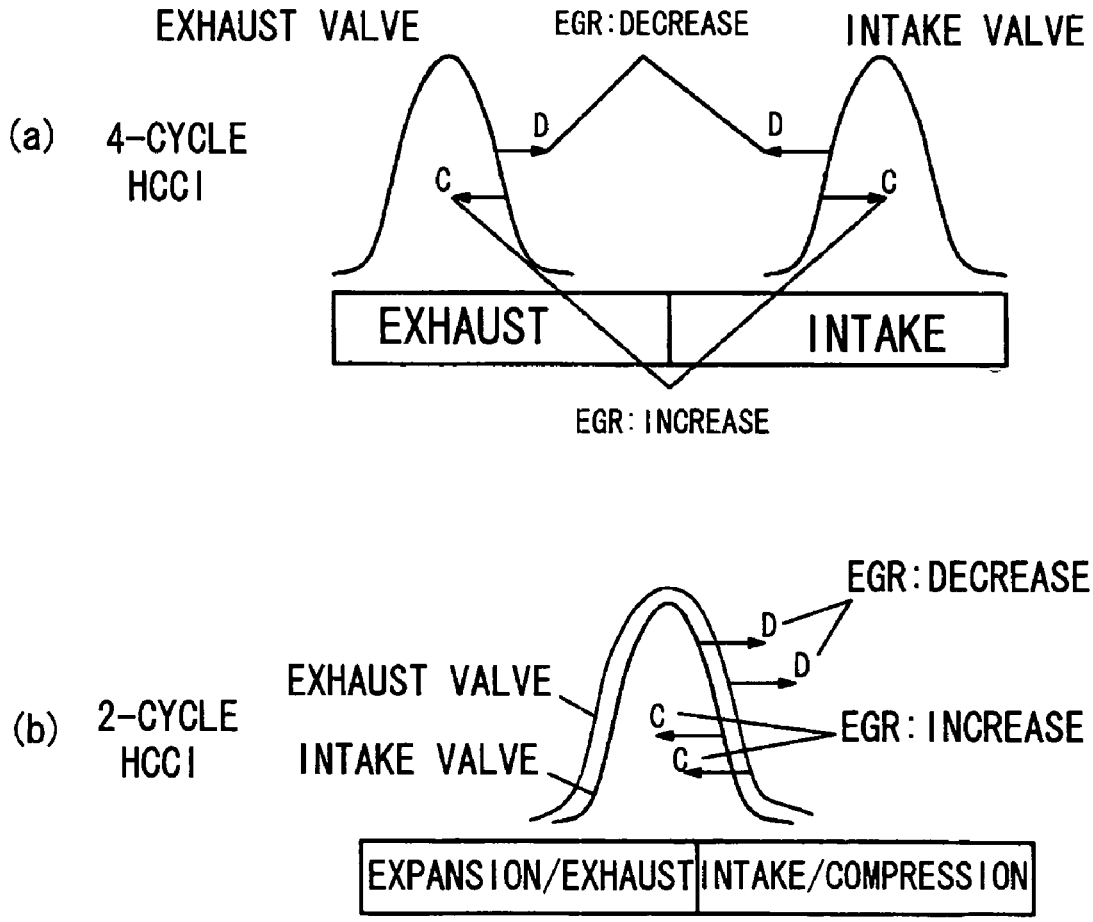
FIG. 7 is the same chart as in FIG. 6 but in more details.

FIG. 7 shows a relation of the valve timing with the internal EGR amount in such strokes as hatched in FIG. 6. The magnitude of the EGR amount can be controlled by changing the valve closing timing for the exhaust valve or the valve opening timing for the intake valve in the respective directions as illustrated in FIG. 7. Accordingly, it is possible to adjust the temperature in the cylinder so as to become equal to the intake air temperature before the compression stroke as described above with reference to FIG. 2.

In case of the 4-cycle combustion, all of the combusted gas is, usually (that is, EGR=0), exhausted by opening the exhaust valve at the exhaust stroke. The internal EGR amount is controlled by adjusting the exhaust valve closing timing or the intake valve opening timing so as to remain a part of the combusted gas within the cylinder without exhausting all of the gas. More specifically, the EGR amount is increased when each valve timing is changed toward a direction indicated by an arrow C in FIG. 7(*a*) whereas the EGR amount is decreased when each valve timing is changed toward a direction indicated by an arrow D in FIG. 7(*a*). A valve lift amount may be set to be variable instead of or in addition to the change of the valve timing.

In case of the 2-cycle combustion, usually, the exhaust valve is opened to start the emission at the almost half of the expansion/exhaust stroke and immediately thereafter the air intake valve is opened because the cylinder pressure decreases. Because the combusted gas flows toward the exhaust valve and the piston moves downward, the fresh air flows in from the air intake valve side. Such movement continues even when the intake/compression starts, and resultantly the fresh air pushes out the exhaust gas (a part of the fresh air is exhausted together). Gas exchange is suspended halfway by closing the intake valve and the exhaust valve in an earlier timing, so that the EGR amount can be increased. In other words, the EGR amount is increased when each valve timing is changed toward the direction indicated by an arrow C in FIG. 7(*b*) whereas the EGR amount is decreased when each valve timing is changed toward the direction indicated by an arrow D in FIG. 7(*b*).

The technology for switching between 4-cycle HCCI operation and the 2-cycle HCCI operation has been described above, but there may happen a problem about the output torque at the time of switching the operation between the 4-cycle and the 2-cycle. For example, when the operation is changed from the 4-cycle to the 2-cycle with the engine rotational speed being kept unchanged, the number of the ignitions of the engine in the 2-cycle becomes two times as much as the 4-cycle and accordingly the output torque also becomes twice. In order to achieve a smooth operation even when the operation is switched over between the 4-cycle and the 2-cycle, it is required to avoid an abrupt change in the torque.

Figure 8:
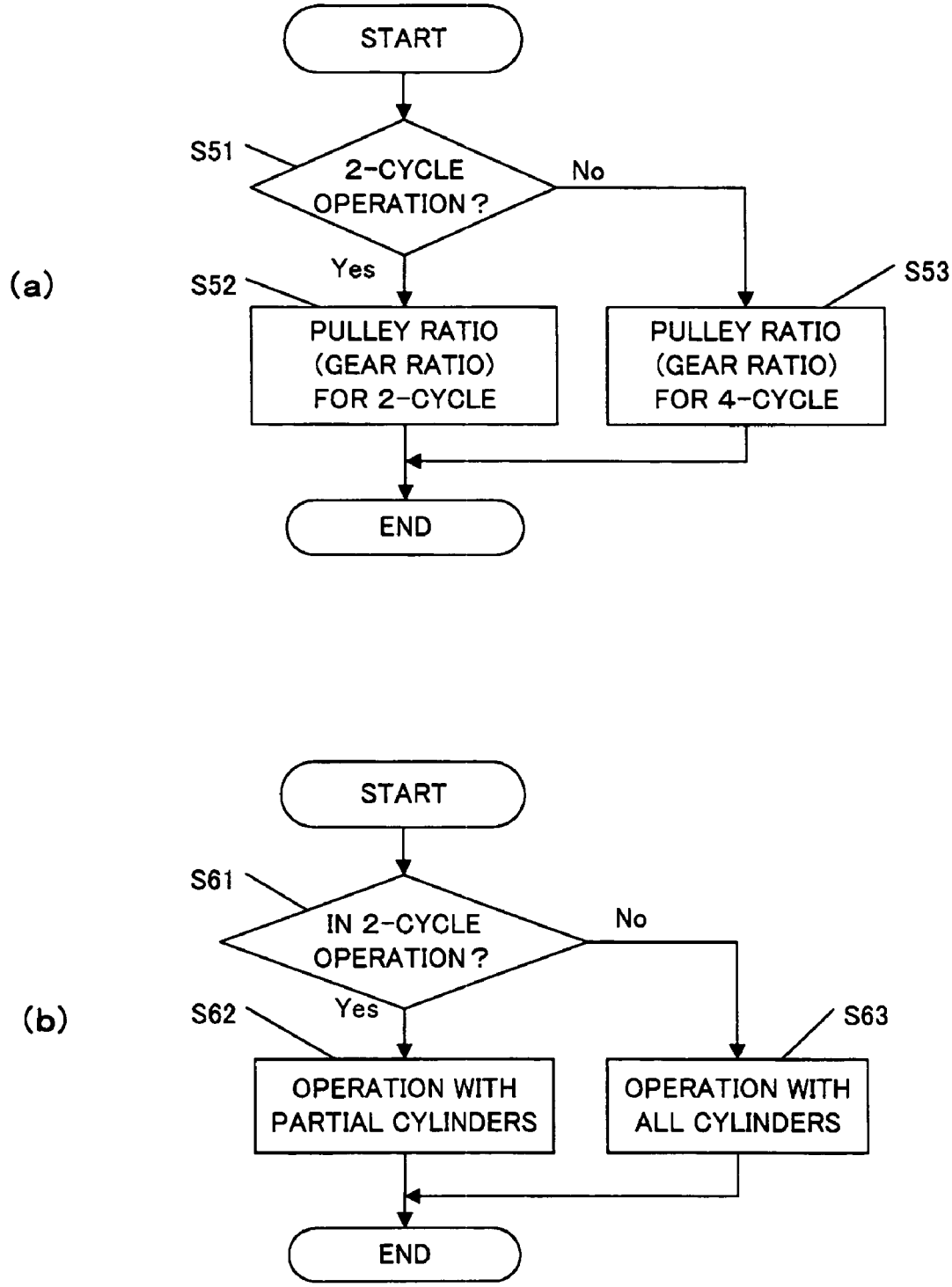
FIG. 8 shows a flowchart of techniques for avoiding an abrupt change in the output torque.

FIG. 8 shows a flowchart of techniques for avoiding the abrupt change in the output torque. Two embodiments will be described below. FIG. 8(*a*) shows one of the techniques, which doubles a pulley ratio when the vehicle is a type of CVT (Continuously Variable Transmission) and doubles a gear ratio when the vehicle is a type of MT (Manual Transmission) or AT (Automatic Transmission). In Step S51, it is determined whether or not the operation is in the 2-cycle operation condition. When it is determined that the operation is not in the 2-cycle operation condition, the pulley ratio or the gear ratio is set to a value for the 4-cycle operation in Step S53. When it is determined that the operation is in the 2-cycle operation condition, the pulley ratio or the gear ratio is set to a value for the 2-cycle operation in Step S52. The pulley ratio or the gear ratio for the 2-cycle operation is almost two times as much as for the 4-cycle.

FIG. 8(*b*) shows another technique, which reduces the number of the cylinders in half without changing the gear ratio. For example, when the vehicle is a 6-cylinder type, three cylinders are stopped to operate at the 2-cycle operation time and the remaining three cylinders continue to operate. In Step S61, it is determined whether or not the operation is in the 2-cycle operating condition. When it is determined that the operation is not in the 2-cycle operating condition, all of the cylinders are set to operate in Step S63. When it is determined that the operation is in the 2-cycle operating condition, a half of the cylinders are set to stop to operate

What is claimed is:

1. An internal combustion engine capable of operating in a compression ignition combustion mode in a given operation range, the engine comprising:

detecting means for detecting operating conditions of the engine;

determining means for determining, based on a rotational speed and load of the engine, a 4-cycle compression ignition mode and a 2-cycle compression ignition mode, wherein when the engine is in a 2-cycle compression mode, the 4-cycle compression ignition mode is selected if exhaust gas temperature is detected to be higher than a predetermined value; and controlling means for controlling the engine to perform the compression ignition mode determined by the determining means.

2. The engine as claimed in claim 1, wherein the detecting means comprises a sensor for detecting an exhaust air fuel ratio of the engine.

3. The engine as claimed in claim 1, further comprising torque maintaining means for preventing a variation in output torques when the operation cycle is changed from 4-cycle to 2-cycle based on the determination results by the determining means.

4. An electronic control unit for an internal combustion engine capable of operating in a compression ignition combustion mode in a given operation range, the electronic control unit being programmed to:

detect operating conditions of the engine;

determine, based on a rotational speed and load of the engine, a 4-cycle compression ignition mode and a 2-cycle compression ignition mode, wherein when the engine is in a 2-cycle compression mode, the 4-cycle compression ignition mode is selected if exhaust gas temperature is detected to be higher than a predetermined value; and control the engine to operate in the determined compression ignition mode.

5. The electronic control unit as claimed in claim 4, wherein the operating conditions include an air fuel ratio of the engine.

6. The electronic control unit as claimed in claim 4, further programmed to maintain torque to prevent variation in output torques when the operation mode is changed from 4-cycle to 2-cycle as determined based on the operating conditions of the engine.

7. A method for controlling an internal combustion engine capable of operating in a compression ignition combustion mode in a given operation range, comprising the steps of:

detecting operating conditions of the engine;

determining, based on a rotational speed and load of the engine, a 4-cycle compression ignition mode and a 2-cycle compression ignition mode, wherein when the engine is in a 2-cycle compression mode, the 4-cycle compression ignition mode is selected if exhaust gas temperature is detected to be higher than a predetermined value; and controlling the engine to operate in the determined compression ignition mode.

8. The method as claimed in claim 7, wherein the operating conditions include an air fuel ratio of the engine.

9. The method as claimed in claim 7, further comprising the step of maintaining torque to prevent variation in output torques when the operation mode is changed from 4-cycle to 2-cycle as determined based on the operating conditions of the engine.

* * * * *